US005186155A

United States Patent [19]

Miyashita et al.

[11] Patent Number: 5,186,155

[45] Date of Patent: Feb. 16, 1993

[54] AIR-FUEL RATIO CONTROL METHOD FOR INTERNAL COMBUSTION ENGINES

[75] Inventors: Yukio Miyashita; Hiroshi Mifune; Kunio Noguchi; Hironao Fukuchi, all of Wako, Japan

[73] Assignee: Honda Giken Kogyo Kabushiki Kaisha, Tokyo, Japan

[21] Appl. No.: 810,505

[22] Filed: Dec. 19, 1991

[30] Foreign Application Priority Data

Dec. 27, 1990 [JP] Japan ..... 2-414928

[51] Int. Cl.[5] ..... F02M 51/00

[52] U.S. Cl. ..... 123/685; 123/491; 123/686; 364/431.1

[58] Field of Search ..... 123/1.89, 940, 478, 123/491, 493, 488, 685, 686; 364/431.1, 431.04, 431.07, 431.05

[56] References Cited

U.S. PATENT DOCUMENTS 4,310,888 1/1982 Furuhashi et al. ..... 123/491
4,996,644 2/1991 Fakuchi et al. ..... 304/431.05
5,021,959 6/1991 Jundt et al. ..... 364/431.05
5,076,238 12/1991 Rosanau et al. ..... 123/491
5,107,431 4/1992 Ohta et al. ..... 364/431.1

FOREIGN PATENT DOCUMENTS 59208141 11/1984 Japan ..... 123/685
6090948 5/1985 Japan ..... 123/685

*Primary Examiner*—Raymond A. Nelli
*Attorney, Agent, or Firm*—Lyon & Lyon

[57] ABSTRACT

An air-fuel ratio control method for an internal combustion engine. The air-fuel ratio of an air-fuel mixture supplied to the engine is feedback-controlled to a desired air-fuel ratio depending on operating conditions of the engine in response to output from an exhaust gas ingredient concentration sensor. The desired air-fuel ratio is settable to a value leaner than a stoichiometric air-fuel ratio when the temperature of the engine is above a predetermined reference value. The method comprises the steps of detecting a reduction ratio to which the transmission has been set, and changing the predetermined reference value of the temperature of the engine depending on the detected reduction ratio. The predetermined reference value of the temperature of the engine is set to a lower value as the reduction ratio of the transmission is smaller.

4 Claims, 7 Drawing Sheets

TO 19
22
TRANSMISSION
1
INTERNAL COMBUSTION ENGINE
THREE-WAY CATALYST
14
LAF
15
13
12
CYL
11
NE
10
TW
9
TA
8
PBA
7
4
θ TH
3
3'
2
6
FUEL INJECTION VALVE
16
PA
17
VSP
18
CSW
19
GP
5a
5b
5c
5d
INPUT CIRCUIT
C P U
MEMORY MEANS
OUTPUT CIRCUIT
ECU
5
ELECTROMAGNETIC VALVE
21
POIL
20

FIG.5

| | PB1 | PB2 | ..... | PB10 |
|---|---|---|---|---|
| NEM1 | KBSM(1,1) | KBSM(1,2) | | KBSM(1,10) |
| NEM2 | KBSM(2,1) | KBSM(2,2) | | KBSM(2,10) |
| ..... | | | | |
| NEM20 | KBSM(20,1) | KBSM(20,2) | | KBSM(20,10) |

AIR-FUEL RATIO CONTROL METHOD FOR INTERNAL COMBUSTION ENGINES

BACKGROUND OF THE INVENTION

The present invention relates to a method of feedback-controlling the air-fuel ratio of an internal combustion engine, and more particularly, it relates to a method of this kind wherein the air-fuel mixture supplied to the engine is feedback-controlled to a desired air-fuel ratio in response to the output of an exhaust gas ingredient concentration sensor having output characteristics in approximate proportion to the concentration of an exhaust gas ingredient.

Among conventional methods for feedback-controlling the air-fuel ratio of an air-fuel mixture supplied to an internal combustion engine (hereinafter referred to as "supply air-fuel ratio") to a desired air-fuel ratio in response to the output of an exhaust gas ingredient concentration sensor having output characteristics proportional to the concentration of an exhaust gas ingredient, the desired air-fuel ratio being set to a value leaner than a stoichiometric ratio, depending on operating conditions of the engine, there is a method proposed, e.g. by Japanese Provisional Patent Publication (Kokai) No. 59-208141 wherein when the engine temperature is low (e.g. during warming-up of the engine), the desired air-fuel ratio is changed in an enriching direction according to the engine temperature.

In general, if so called lean-burn control in which the desired air-fuel ratio is controlled to a value leaner than the stoichiometric air-fuel ratio is performed when the engine temperature is low, misfire etc. is liable to occur due to an unstable combustion state of the air-fuel mixture, which results in degraded driveability. Therefore, according to the proposed method, the lean-burn control is inhibited when the engine temperature is low.

However, since this proposed method contemplates the engine temperature alone in determining whether the lean-burn control is to be carried out, there can be the possibility that the desired air-fuel ratio is set to the stoichiometric air-fuel ratio or a value richer than same even when the lean-burn control can be suitably carried out. Therefore, the proposed method is disadvantageous in respect of fuel consumption.

SUMMARY OF THE INVENTION

It is the object of the invention to provide an air-fuel ratio control method for an internal combustion engine, which enables to improve the fuel consumption without degrading the driveability, by properly determining whether or not the lean-burn control can be carried out.

To attain the above object, the present invention provides an air-fuel ratio control method for an internal combustion engine including an intake passage, an exhaust gas ingredient concentration sensor arranged in the exhaust passage for producing output substantially proportional to the concentration of an ingredient in exhaust gases emitted from the engine, and a transmission, wherein the air-fuel ratio of an air-fuel mixture supplied to the engine is feedback-controlled to a desired air-fuel ratio depending on operating conditions of the engine in response to the output from the exhaust gas ingredient concentration sensor, the desired air-fuel ratio being settable to a value leaner than a stoichiometric air-fuel ratio when a temperature of the engine is above a predetermined reference value.

The air-fuel ratio control method according to the invention is characterized by comprising the steps of:

(1) detecting a reduction ratio to which the transmission has been set; and (2) changing the predetermined reference value of the temperature of the engine depending on the detected reduction ratio.

Preferably, the predetermined reference value of the temperature of the engine is set to a lower value as the reduction ratio of the transmission is smaller.

Also preferably, the desired air-fuel ratio is settable to the value leaner than the stoichiometric air-fuel ratio when the engine is in a predetermined low load condition while the temperature of the engine is above the predetermined reference value.

For example, the temperature of the engine is the temperature of a coolant of the engine.

The above and other objects, features and advantages of the invention will become more apparent from the ensuing detailed description taken in conjunction with the accompanying drawings.

BRIEF DESCRIPTION OF THE DRAWINGS

FIG. 3, comprising

FIG. 5 is a diagram showing a KBSM map for basic values of the desired air-fuel ratio coefficient.

DETAILED DESCRIPTION

The method according to the invention will now be described in detail with reference to the drawings showing an embodiment thereof.

Figure 1:
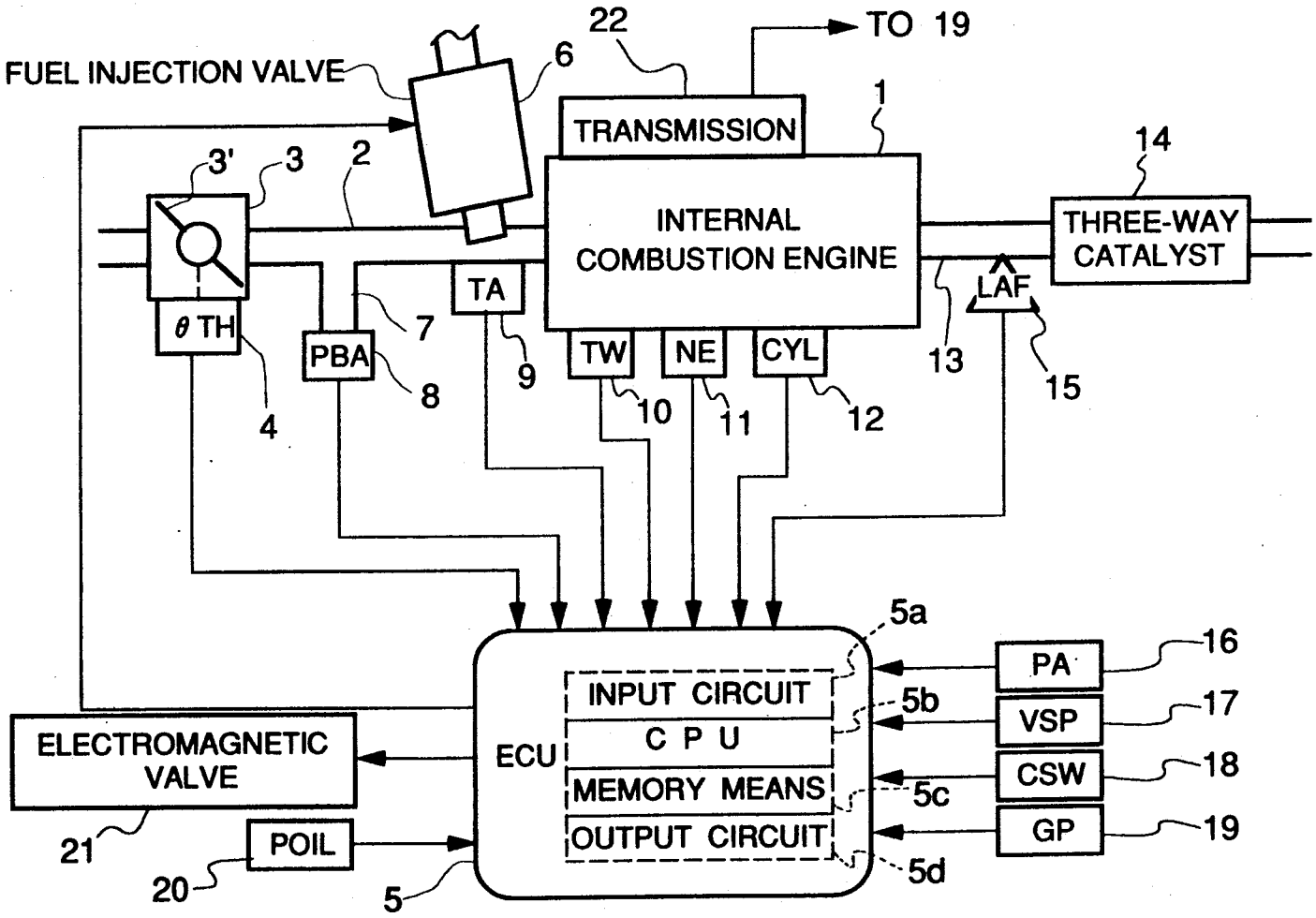
FIG. 1 is a block diagram illustrating the whole arrangement of a fuel supply control system for carrying out the control method of the invention.

Referring first to FIG. 1, there is shown the whole arrangement of a fuel supply control system which is adapted to carry out the control method of this invention. In the figure, reference numeral 1 designates a DOHC straight type four cylinder engine, each cylinder being provided with a pair of intake valves and a pair of exhaust valves, not shown. This engine 1 is arranged such that operating characteristics of the intake valves and exhaust valves (more specifically, the valve opening period and the lift; generically referred to hereinafter as "valve timing") permit selection between a high speed valve timing adapted to a high engine speed region and a low speed valve timing adapted to a low engine speed region.

In an intake pipe 2 of the engine 1, there is arranged a throttle body 3 accommodating a throttle body 3' therein. A throttle valve opening ($\theta$TH) sensor 4 is connected to the throttle valve 3' for generating an electric signal indicative of the sensed throttle valve opening and supplying same to an electronic control unit (hereinafter referred to as "the ECU") 5.

Fuel injection valves 6 are each provided for each cylinder and arranged in the intake pipe 2 between the engine 1 and the throttle valve 3, and at a location slightly upstream of an intake valve, not shown. The fuel injection valves 6 are connected to a fuel pump, not shown, and electrically connected to the ECU 5 to have their valve opening periods controlled by signals therefrom.

An electromagnetic valve 21 is connected to the output side of the ECU 5 to selectively control the aforementioned valve timing, the opening and closing of this electromagnetic valve 21 being controlled by the ECU 5. The valve 21 selects either high or low hydraulic pressure applied to a valve timing selection mechanism, not shown. Corresponding to this high or low hydraulic pressure, the valve timing is thereby adjusted to either a high speed valve timing or a low speed valve timing. The hydraulic pressure applied to this selection mechanism is detected by a hydraulic pressure (oil pressure) (POIL) sensor 20 which supplies a signal indicative of the sensed hydraulic pressure to the ECU 5.

Further, an intake pipe absolute pressure (PBA) sensor 8 is provided in communication with the interior of the intake pipe 2 via a conduit 7 at a location immediately downstream of the throttle valve 3' for supplying an electric signal indicative of the sensed absolute pressure to the ECU 5. An intake temperature (TA) sensor 9 is inserted into the intake pipe 2 at a location downstream of the intake pipe absolute pressure sensor 8 for supplying an electric signal indicative of the sensed intake temperature TA to the ECU 5.

An engine coolant temperature (TW) sensor 10, which may be formed of a thermistor or the like, is mounted in the cylinder block of the engine 1 for supplying an electric signal indicative of the sensed engine coolant temperature TW to the ECU 5. An engine rotational speed (NE) sensor 11 and a cylinder-discriminating (CYL) sensor 12 are arranged in facing relation to a camshaft or a crankshaft of the engine 1, neither of which is shown. The engine rotational speed sensor 11 generates a pulse as a TDC signal pulse at each of predetermined crank angles whenever the crankshaft rotates through 180 degrees, while the cylinder-discriminating sensor 12 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious components such as HC, CO and $NO_X$. An $O_2$ sensor 15 as an exhaust gas ingredient concentration sensor (referred to hereinafter as an "LAF sensor") is mounted in the exhaust pipe 13 at a location upstream of the three-way catalyst 14, for supplying an electric signal having a level approximately proportional to the oxygen concentration in the exhaust gases to the ECU 5.

Further electrically connected to the ECU 5 are an atmospheric pressure (PA) sensor 16, a vehicle speed (VSP) sensor 17, a clutch sensor 18 for detecting when the clutch is engaged and disengaged, and a gear position sensor 19 for detecting the shift position of a transmission, 22 connected to the engine 1. The signals from all these sensors are supplied to the ECU 5.

The ECU 5 comprises an input circuit 5*a* having the functions of shaping the waveforms of input signals from various sensors, shifting the voltage levels of sensor output signals to a predetermined level, converting analog signals from analog-output sensors to digital signals, and so forth, a central processing unit (hereinafter referred to as "the CPU") 5*b*, memory means 5*c* storing various operational programs which are executed in the CPU 5*b* and for storing results of calculations therefrom, etc., and an output circuit 5*d* which outputs driving signals to the fuel injection valves 6 and the electromagnetic valve 21.

The CPU 5*b* operates in response to the above-mentioned signals from the sensors to determine operating conditions in which the engine 1 is operating such as an air-fuel ratio feedback control region and open-loop control regions, and calculates, based upon the determined operating conditions, the valve opening period or fuel injection period $T_{OUT}$ over which the fuel injection valves 6 are to be opened by the use of the following equation (1) in synchronism with inputting of TDC signal pulses to the ECU 5:

$$T_{OUT} = Ti \times KCMDM \times KLAF \times K_1 + K_2 \quad (1)$$

where Ti represents a basic fuel amount, more specifically a basic fuel injection period which is determined according to the engine rotational speed Ne and the intake pipe absolute pressure PBA. The value of Ti is determined by a Ti map stored in the memory means 5*c*.

KCMDM is a modified desired air-fuel ratio coefficient which is set by means of a program shown in FIG. 2, described hereinafter, according to engine operating conditions, and calculated by multiplying a desired air-fuel ratio coefficient KCMD representing a desired air-fuel ratio by a fuel cooling correction coefficient KETV. The correction coefficient KETV is intended to apply a prior correction to the fuel injection amount in view of the fact that the supply air-fuel ratio varies due to the cooling effect produced when fuel is actually injected, and its value is set according to the value of the desired air-fuel ratio coefficient KCMD. Further, as will be clear from the aforementioned equation (1), the fuel injection period $T_{OUT}$ increases if the desired fuel-air injection ratio coefficient KCMD increases, so that the values of KCMD and KCMDM will be in direct proportion to the reciprocal of the air-fuel ratio A/F.

KLAF is an air-fuel ratio correction coefficient which is set such that the air-fuel ratio detected by the LAF sensor 15 during air-fuel ratio feedback control coincides with the desired air-fuel ratio, and is set to predetermined values depending on engine operating conditions during open-loop control.

$K_1$ and $K_2$ are other correction coefficients and correction variables, respectively, which are calculated based on various engine parameter signals to such values as to optimize characteristics of the engine such as fuel consumption and accelerability depending on engine operating conditions.

The CPU 5*b* outputs a valve timing selection command signal depending on engine operating conditions, which causes opening and closing of the electromagnetic valve 21.

The CPU 5*b* performs calculations as described hereintofore, and supplies the fuel injection valves 6 and electromagnetic valve 21 with driving signals based on the calculation results through the output circuit 5*d*.

Figure 2:
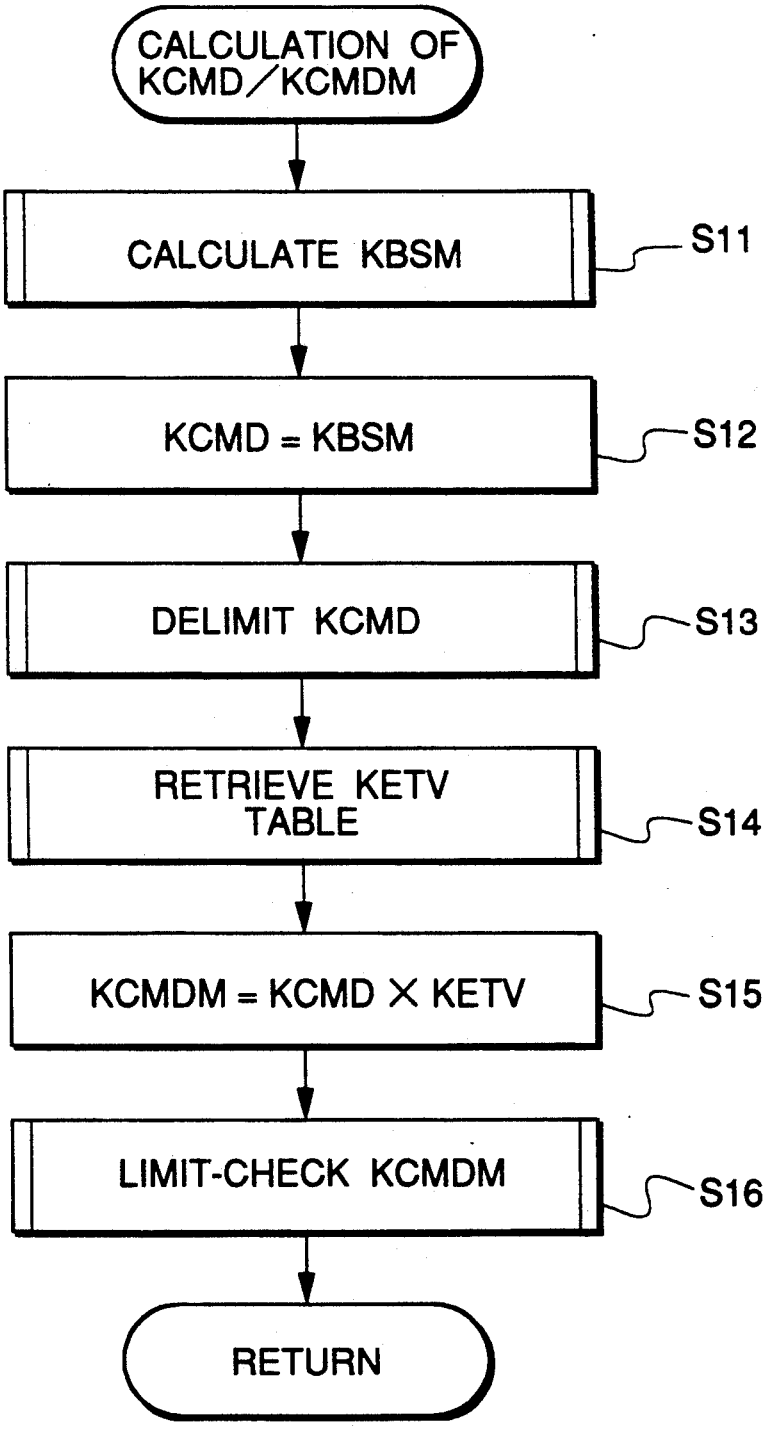
FIG. 2 is a flowchart of a program for calculating a desired air-fuel ratio coefficient (KCMD) and a modified desired air-fuel ratio coefficient (KCMDM).

FIG. 2 shows a program which calculates the desired air-fuel ratio coefficient KCMD and modified air-fuel ratio coefficient KCMDM, when the engine is in a normal operating condition other than a predetermined high load operating condition in which the fuel supply to the engine should be increased and a predetermined low load operating condition in which the fuel supply to the engine should be cut off. This program is carried out in synchronism with inputting of each TDC signal pulse to the ECU 5.

At a step S11, a basic value KBSM of the desired air-fuel ratio coefficient is calculated by a program described in detail hereinafter with reference to FIG. 3, and the calculated basic value KBSM is set as a value of the desired air-fuel ratio coefficient KCMD at a step S12. At a step S13, delimiting of the value of the coefficient KCMD is carried out such that the difference between the immediately preceding value and the present value of the coefficient KCMD does not exceed an upper limit value set in accordance with engine operating conditions in order to prevent the value of the coefficient KCMD from being drastically changed. However, in the embodiment, under a condition that the coefficient KCMD assumes a value leaner than the stoichiometric air-fuel ratio, if the accelerator pedal is violently stepped on or in like cases, the value of the coefficient KCMD is immediately increased to a value corresponding to the stoichiometric air-fuel ratio.

Following the delimiting of the value of the coefficient KCMD, at a step S14, a value of the fuel cooling correction coefficient KETV is read from a table, not shown, in which values of the coefficient KETV are set in accordance with the coefficient KCMD, and the value of the coefficient KCMD is multiplied by the obtained value of the coefficient KETV to thereby calculate the modified desired air-fuel ratio coefficient KCMDM at a step S15. Then, limit checking of the calculated value of the coefficient KCMDM is carried out at a step S16, followed by terminating the present program. In the limit checking, it is determined whether or not the calculated value of the coefficient KCMDM falls within a range defined by predetermined upper and lower limit values, and if the value is outside the range, the coefficient KCMDM is set to the predetermined upper or lower limit value.

After execution of the present program, another routine, not shown, is executed, where when the engine is in a condition which enables to perform the air-fuel ratio feedback control, the air-fuel ratio correction coefficient KLAF is calculated such that an equivalent ratio KACT which is calculated based on the output from the LAF sensor 15 and representing a detected air-fuel ratio will become equal to the obtained desired air-fuel ratio coefficient KCMD.

Figure 3A:
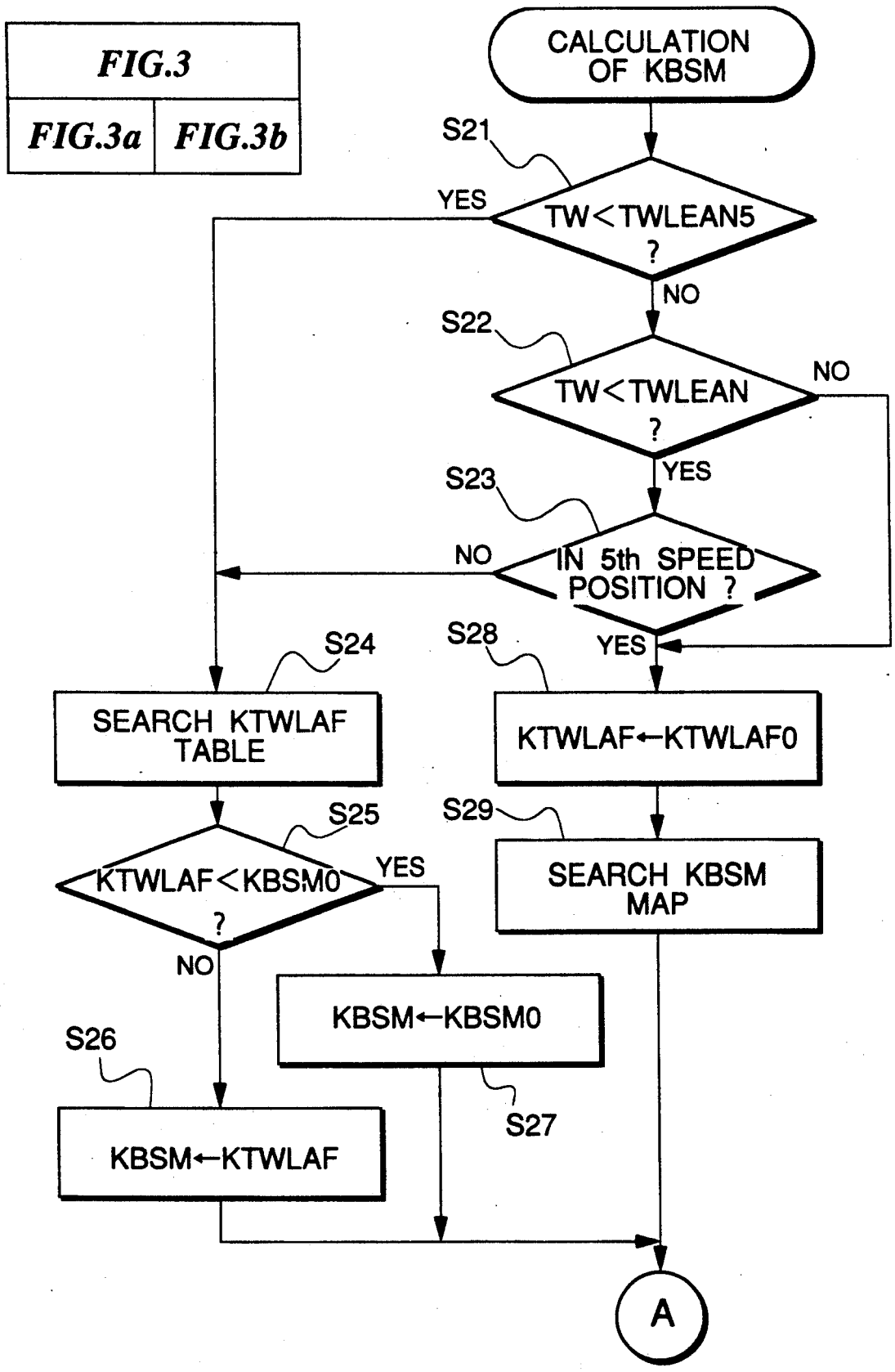
FIGS. 3*a* and 3*b* is a flowchart of a program for calculating a basic value (KBSM) of the desired air-fuel ratio coefficient.
Figure 3B:
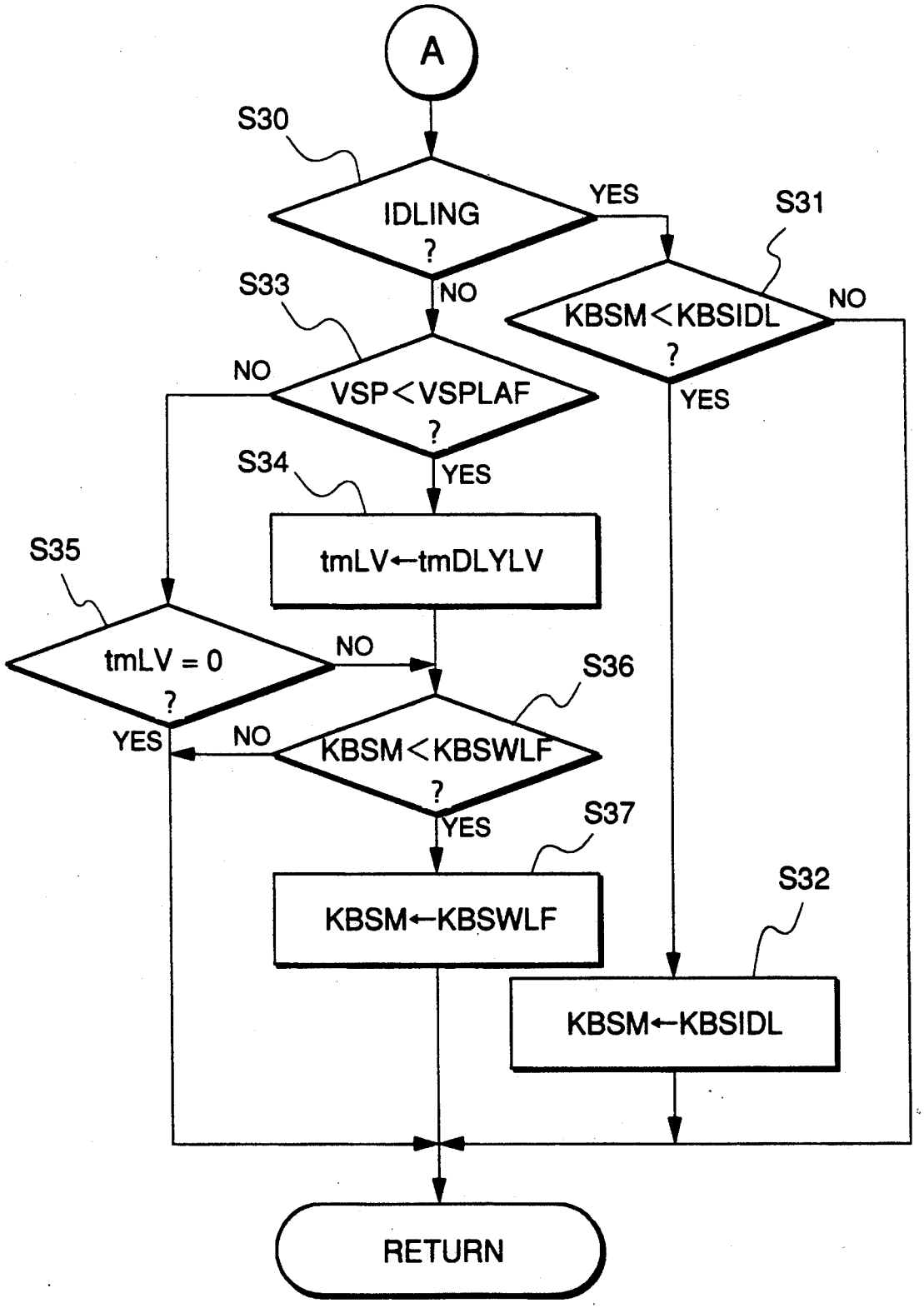

FIG. 3 shows a subroutine carried out at the step S11 in FIG. 2 to calculate the basic value KBSM of the desired air-fuel ratio coefficient.

At a step S21, it is determined whether or not the engine coolant temperature TW is lower than a first predetermined value TWLEAN5 (e.g. 65° C.). If the answer to this question is affirmative (YES), i.e. if TW<TWLEAN5, a low coolant temperature desired air-fuel ratio coefficient KTWLAF is read from a KTWLAF table according to the engine coolant temperature TW and the intake pipe absolute pressure PBA at a step S24.

Figure 4:
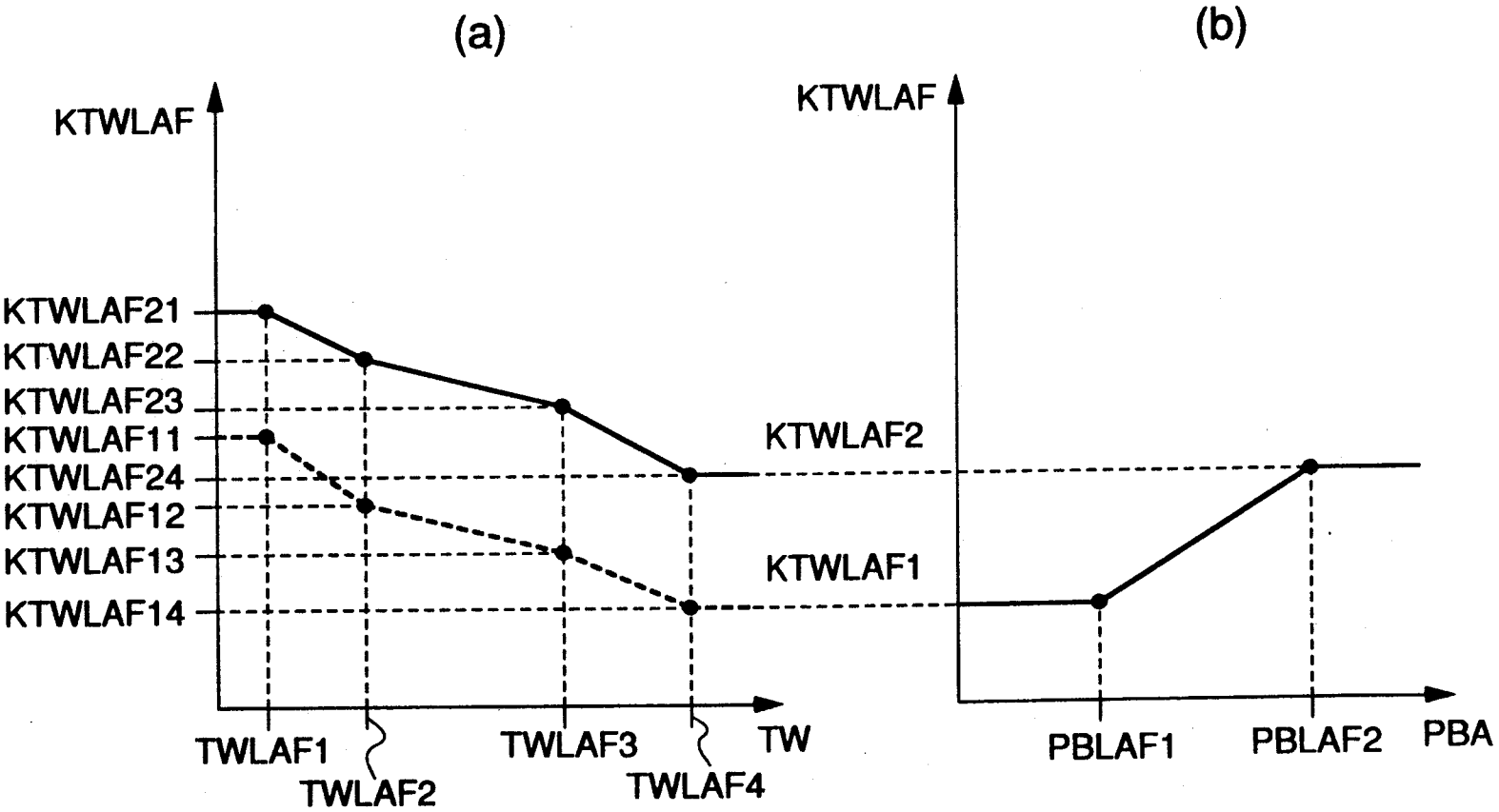
FIG. 4 is a diagram showing a KTWLAF table for a low coolant temperature desired air-fuel ratio coefficient.

As shown in FIG. 4, the KTWLAF table comprises a characteristic curve KTWLAF1 (indicated by the broken line in (a) of FIG. 4) to be applied when the intake pipe absolute pressure PBA is below a predetermined value PBLAF1, and a characteristic curve KTWLAF2 (indicated by the solid line in (a) of same) to be applied when the intake pipe absolute pressure PBA is above a predetermined value PBLAF2. As shown in (a) of the figure, predetermined values KTWLAF11 to KTWLAF14 and KTWLAF21 to KTWLAF24 are set corresponding respectively to predetermined values TWLAF1 to TWLAF4 of the engine coolant temperature TW. Accordingly, at the step S24, if a condition of PBA≧PBLAF2 or PBA≦PBALAF1 is satisfied, a value on the characteristic curve KTWLAF2 or KTWLAF1 is read from the KTWLAF table at (a) of the figure according to the engine coolant temperature (KTWLAF values corresponding to values other than the predetermined set values TWLAF1 to TWLAF4 are obtained by interpolation according to the engine coolant temperature TW), whereas if a condition of PBLAF1<PBA<PBLAF2 is satisfied, values on the characteristic curves KTWLAF2 and KTLAF1 are read in a similar manner from (a) of the figure and the read values are subjected to interpolation according to the intake pipe absolute pressure PBA to calculate a value of KTWLAF. The values of KTWLAF set in the KTWLAF table are richer than a value corresponding to a stoichiometric air-fuel ratio, and by thus setting the basic value KBSM of the desired air-fuel ratio to a value of KTWLAF richer than the stoichiometric ratio, the amount of fuel supplied to the engine is increased when the engine coolant temperature is low.

At a step S25, it is determined whether or not the KTWLAF value read at the step S24 is smaller than a predetermined value KBSMO (e.g. a value corresponding to A/F=14.3 to 14.7). If the answer to this question is negative (NO), the basic value KBSM of the desired air-fuel ratio coefficient is set to the KTWLAF value read at the step S24 at a step S26, followed by the program proceeding to a step S30. On the other hand, if the answer to the question of the step S25 is affirmative (YES), i.e. if KTWLAF<KBSMO, the basic value KBSM is set to the predetermined value KBSMO at a step S27, followed by the program proceeding to the step S30.

If the answer to the question of the step S21 is negative (NO), i.e. if TW≧TWLEAN5, it is determined whether or not the engine coolant temperature TW is lower than a second predetermined value TWLEAN (e.g. 75° C.) which is higher than the first predetermined value TWLEAN5, at a step S22. If the answer to this question is negative (NO), i.e. if TW≧TWLEAN, the low temperature desired air-fuel ratio coefficient KTWLAF is set to a value KTWLAFO corresponding to the stoichiometric air-fuel ratio at a step S28, and a KBSM map is searched at a step S29, followed by the program preceeding to the step S30. In the KBSM map, as shown in FIG. 5, for example, predetermined values $KBSM_{(1,1)}$ to $KBSM_{(20,10)}$ correspond respectively to grid points determined by twenty predetermined values NEM1 to NEM20 of the engine rotational speed and ten predetermined values PB1 to PB10 of the intake pipe absolute pressure PBA. A value of the basic value KBSM is read from the KBSM map according to a detected value of the engine rotational speed NE and the estimated value (hereinafter referred to as the "estimated PBA value") of the intake pipe absolute pressure PBA. If the detected engine rotational speed NE and the estimated PBA value assume values other than those at the grid points, the basic value KBSM is calculated by interpolation. A manner of calculation of the estimated PBA value is disclosed in Japanese Provisional Patent Publication (Kokai) No. 60-90948. Further, in the above retrieval from the KBSM map, the detected value of the intake pipe absolute pressure PBA may be used instead of the estimated PBA value.

The KBSM map is set such that the read basic value KBSM assumes a value leaner than the stoichiometric ratio when the engine is in a predetermined low load operating condition (e.g. a condition where the engine rotational speed NE and the intake pipe absolute pressure are below respective predetermined values). Therefore, if a value which is read not from the aforementioned KTWLAF table but from the KBSM map is used as a basic value of the desired air-fuel ratio, the lean-burn control is carried out when the engine is in the predetermined low load operating condition.

If the answer to the question of the step S21 is negative (NO), and at the same time the answer to the question of the step S22 is affirmative (YES), i.e. if TWLEAN5≦TW<TWLEAN, it is determined whether or not the transmission 22 of the engine is in a fifth speed position (i.e. whether or not the reduction ratio of the transmission 22 is small) at a step S23. If the answer to this question is negative (NO), i.e. if the transmission 22 is in a positon other than the fifth speed position, the program proceeds to the step S24, whereas if the answer is affirmative (YES), i.e. if the transmission 22 is in the fifth speed position, the program proceeds to the step S28.

Consequently, if the transmission 22 is in a position other than the fifth speed position, the lean-burn control can be performed when the engine coolant temperature is equal to or higher than the second predetermined value TWLEAN, whereas if the transmission 22 is in the fifth speed position (i.e. if the reduction ratio of the transmission 22 is small), the lean-burn control can be performed when the engine coolant temperature is equal to or higher than the first predetermined value TWLEAN5 which is lower than the second predetermined value TWLEAN. The use of the two different critical engine coolant temperature values TWLEAN and TWLEAN5 for lean-burn control is based on the fact that when the transmission 22 is in the fifth speed position, generally the engine is not required to produce large output torque, and hence the state of combustion of the air-fuel mixture is stable. By virtue of provision of the temperature range between TWLEAN5 and TWLEAN in which the lean-burn control can be performed on condition that the transmission is in the fifth speed position, the temperature range suitable for lean burn control is enlarged, enabling to reduce the fuel consumption without degrading the driveability.

At the step S30, it is determined whether or not the engine is idling. If the answer to this question is affirmative (YES), it is determined at a step S31 whether or not the basic value KBSM obtained at the step S26, S27 or S29 is smaller than a predetermined value KBSIDL (e.g. a value corresponding to A/F=14.7) for idling. If the answer to this question is negative (NO), i.e. if KBSM≧KBSIDL, the present routine is immediately terminated, whereas if the answer is affirmative (YES), i.e. if KBSM<KBSIDL, the basic value KBSM is set to the predetermined value KBSIDL at a step S32, followed by terminating the present routine. Consequently, when the engine is idling, the basic value KBSM is set to a value equal to or larger (richer) than the predetermined value KBSIDL.

If the answer to the question of the step S30 is negative (NO), i.e. if the engine is not idling, it is determined whether or not the vehicle speed VSP is lower than a predetermined value VSPLAF (e.g. 10 km/h) at a step S33. If the answer to this question is affirmative (YES), i.e. if VSP<VSPLAF, a low vehicle speed delay timer tmLV is set to a predetermined time period tmDLYLV (e.g. 300 millisec.) and started at a step S34, and it is determined at a step S36 whether or not the basic value KBSM obtained at the step S26, S27 or S29 is smaller than a predetermined value KBSWLF (e.g. a value corresponding to A/F=14.7) for low vehicle speed. If the answer to this question is negative (NO), i.e. if KBSM≧KBSWLF, the present routine is immediately terminated, whereas if the answer to this question is affirmative (YES), i.e. if KBSM<KBSWLF, the basic value KBSM is set to the predetermined value KBSWLF at a step S37, followed by terminating the present routine.

If the answer to the question of the step S33 is negative (NO), i.e. if VSP≧VSPLAF, it is determined whether or not the count value of the low vehicle speed delay timer tmLV is equal to 0 at a step S35. If the answer to this question is negative (NO), i.e. if tmLV>0, the program proceeds to the step S36, whereas if the answer is affirmative (YES), i.e. if tmLV=0, the present routine is terminated. According to the steps S33 to S37, when the vehicle speed is lower than the predetermined value (VSP<VSPLAF) or before the predetermined time period tmDLYLV elapses after the vehicle speed becomes equal to or higher than the predetermined value, the basic value KBSM is set to a value equal to or higher than the predetermined value KBSWLF for low vehicle speed.

Figure 6:
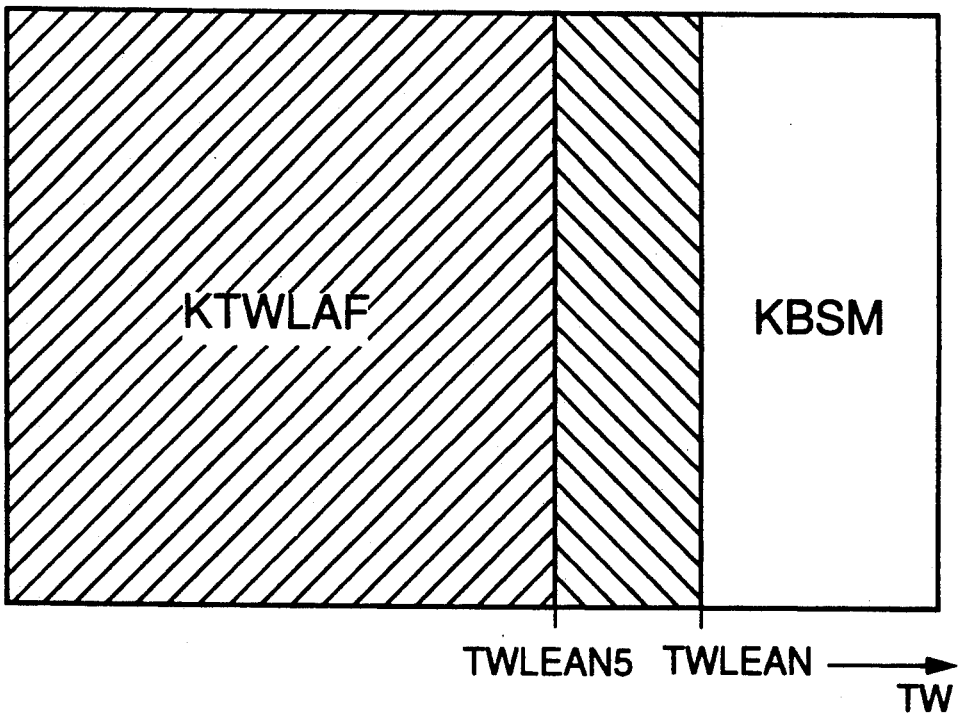
FIG. 6 is a diagram showning regions in which the KTWLAF table and the KBSM map are used, respectively.

According to the program described above with reference to FIG. 3, the KTWLAF table and the KBSM map are used in a selective manner as illustrated in FIG. 6. That is, (i) if TW<TWLEAN5, the KTWLAF table is used, (ii) if TW≧TWLEAN, the KBSM map is used, (iii) if TWLEAN5≦TW<TWLEAN, the KBSM map is used when the transmission is in the fifth speed position (i.e. the reduction ratio of the transmission 22 is small), and the KTWLAF table is used when the transmission is in a position other than the fifth speed position.

What is claimed is:

1. In an air-fuel ratio control method for an internal combustion engine including an intake passage, an exhaust gas ingredient concentration sensor arranged in said exhaust passage for producing output substantially proportional to the concentration of an ingredient in exhaust gases emitted from said engine, and a transmission, wherein the air-fuel ratio of an air-fuel mixture supplied to the engine is feedback-controlled to a desired air-fuel ratio depending on operating conditions of said engine in response to said output from said exhaust gas ingredient concentration sensor, said desired air-fuel ratio being settable to a value leaner than a stoichiometric air-fuel ratio when a temperature of said engine is above a predetermined reference value, the improvement comprising the steps of:

(1) detecting a reduction ratio to which said transmission has been set; and (2) changing said predetermined reference value of said temperature of said engine depending on the detected reduction ratio.

2. An air-fuel ratio control method according to claim 1, wherein said predetermined reference value of said temperature of said engine is set to a lower value as said reduction ratio of said transmission is smaller.

3. An air-fuel ratio control method according to claim 1 or 2, wherein said desired air-fuel ratio is settable to said value leaner than said stoichiometric air-fuel ratio when said engine is in a predetermined low load condition while said temperature of said engine is above said predetermined reference value.

4. An air-fuel ratio control method according to claim 1 or 2, wherein said temperature of said engine is the temperature of a coolant of said engine.

* * * * *